United States Patent [19]

Gamble

[11] 3,936,592

[45] Feb. 3, 1976

[54] ELECTRICAL BUSHING HAVING A CENTRAL CONDUCTOR WITH LARGE PLANAR TERMINAL PORTIONS AT EACH END

[75] Inventor: James R. Gamble, Greensburg, Pa.

[73] Assignee: Westinghouse Electric Corporation, Pittsburgh, Pa.

[22] Filed: Jan. 2, 1975

[21] Appl. No.: 538,065

[52] U.S. Cl. ..... 174/153 R

[51] Int. Cl.[2] ..... H01B 17/26

[58] Field of Search..... 174/18, 31 R, 50.56, 142, 174/152 R, 153 R; 339/94 A, 126 R, 126 RS, 129, 214 R, 214 C

[56] References Cited

UNITED STATES PATENTS

| | | | |
|---|---|---|---|
| 1,042,747 | 10/1912 | Ziegler | 339/214 R |
| 1,141,598 | 6/1915 | Ziegler | 339/214 R |
| 1,768,522 | 6/1930 | Brown | 174/153 R X |
| 1,932,456 | 10/1933 | Gaston | 174/153 R X |
| 2,356,831 | 8/1944 | DeMonte et al. | 174/153 R |
| 2,853,114 | 9/1958 | Barry | 151/69 |

FOREIGN PATENTS OR APPLICATIONS

| | | | |
|---|---|---|---|
| 846,750 | 6/1939 | France | 174/153 R |

*Primary Examiner*—Laramie E. Askin
*Attorney, Agent, or Firm*—L. P. Johns

[57] ABSTRACT

An electrical bushing for a distribution transformer characterized by a pair of tubular insulating members having oppositely disposed facing surfaces engageable with opposite sides of a transformer housing wall, a conductor extending through the members and having first and second planar terminal surfaces, the conductor having an outturned flange near the first planar terminal surface which flange is engageable with one of the tubular insulating members, the conductor also having a threaded portion adjacent the second planar terminal surface, a nut engageable on the threaded portion and abuttable with the end of the other tubular insulating member, and the nut comprising aperture means including a threaded portion engageable with said threaded segment and comprising a slot portion extending outwardly from the threaded portion and adapted to enable passing of the second planar terminal surface therethrough.

3 Claims, 4 Drawing Figures

ELECTRICAL BUSHING HAVING A CENTRAL CONDUCTOR WITH LARGE PLANAR TERMINAL PORTIONS AT EACH END

BACKGROUND OF THE INVENTION

Field of the Invention

This invention relates to a bushing assembly for electrical apparatus and, more particularly, to a low voltage bushing for a distribution transformer.

Description of the Prior Art

Copper has been the customary metal employed for transformer secondary coil leads or conductors. Due to extraordinary cost increases of copper, aluminum has been adopted as a substitute for use as leads or conductors of the secondary windings of distribution transformers. Although aluminum is an excellent electrical conductor, electrical grade aluminum is extremely soft and therefore has presented problems. Electrical grade aluminum in the dead-soft, annealed condition has a very low creep strength and therefore has a tendency to cold flow out of a connector assembly when any compressive force is applied. The problem is particularly prevalent where aluminum is clamped in a connector assembly such as in the terminal connector between internal and external sides of a transformer casing.

SUMMARY OF THE INVENTION

In accordance with this invention it has been found that the foregoing problems may be overcome by providing an electrical bushing for extending through an aperture in a transformer housing wall comprising a pair of tubular insulating members having oppositely disposed facing surfaces engageable with opposite sides of a transformer housing wall, a conductor extending through the insulating members in the aperture and having first and second planar terminal surfaces, means for clamping the insulating members in place against opposite sides of the housing and comprising surface means near the first planar terminal surface, a threaded segment near the second planar terminal surface, a nut engageable with the threaded segment, the surface means being abuttable with a first transverse surface on one of said members, and the nut being abuttable with a second transverse surface on the other of said members so that the pair of tubular insulating members are held in place on the housing wall.

The advantage of the electrical bushing of this invention is that a planar or spade type terminal is provided at both ends of a porcelain secondary bushing for a pole type distribution transformer to provide durable bolted joints between the aluminum conductor of the bushing and leads or busses connected therethrough.

DESCRIPTION OF THE PREFERRED EMBODIMENT

Figure 1:
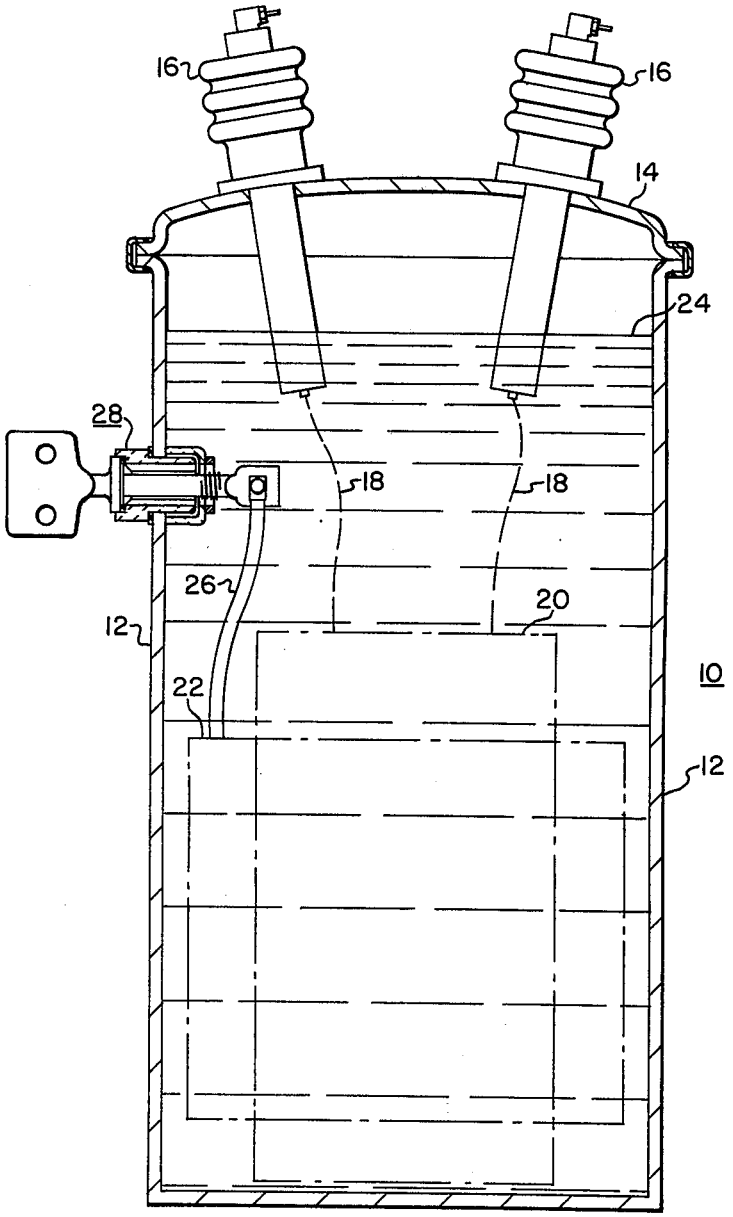
FIG. 1 is a vertical sectional view through a distribution transformer and showing the secondary bushing in accordance with this invention.

In FIG. 1 a distribution transformer is generally indicated at 10 and is comprised of the housing which includes an outer casing or tank 12 and a cover 14, as is typical in the art. Primary conductors of the transformer are fed a high voltage by means of conductor assemblies 16 which include separate similar conductors 18 which lead to primary windings, symbolically illustrated at 20. In a conventional manner the primary windings 20 are magnetically coupled with a secondary winding, symbolically illustrated at 22.

The casing 12 is filled with oil generally indicated at a level 24 to provide a cooling and insulating fluid for the transformer windings 20, 22. The secondary windings 22 comprise several output conductors, one of which is symbolically illustrated at 26 which leads to a connector assembly or bushing generally indicated at 28.

Figure 2:
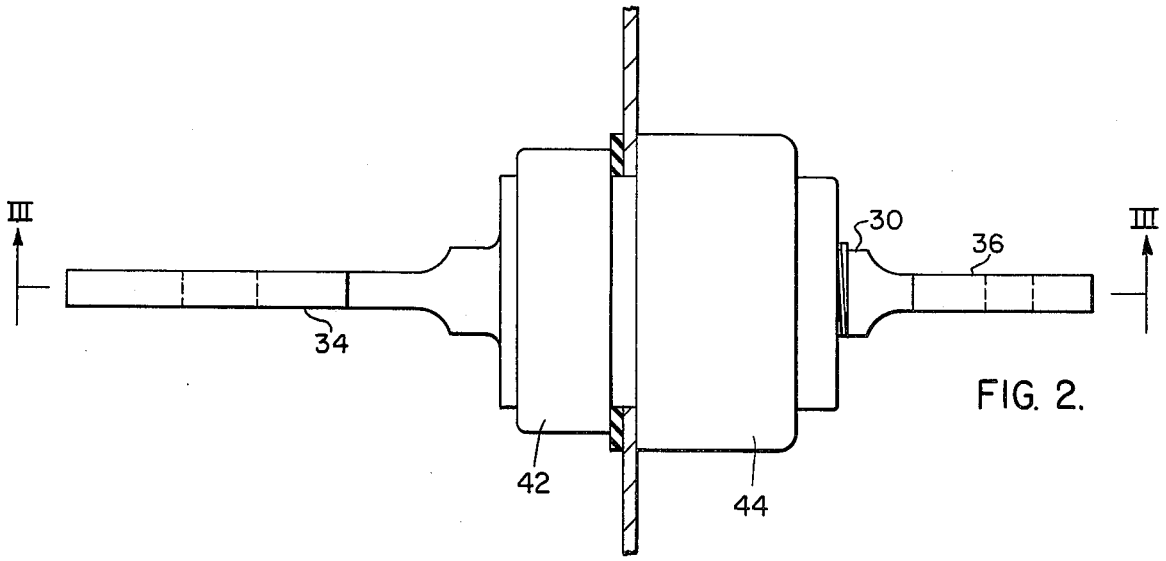
FIG. 2 is an elevational view of the bushing.
Figure 3:
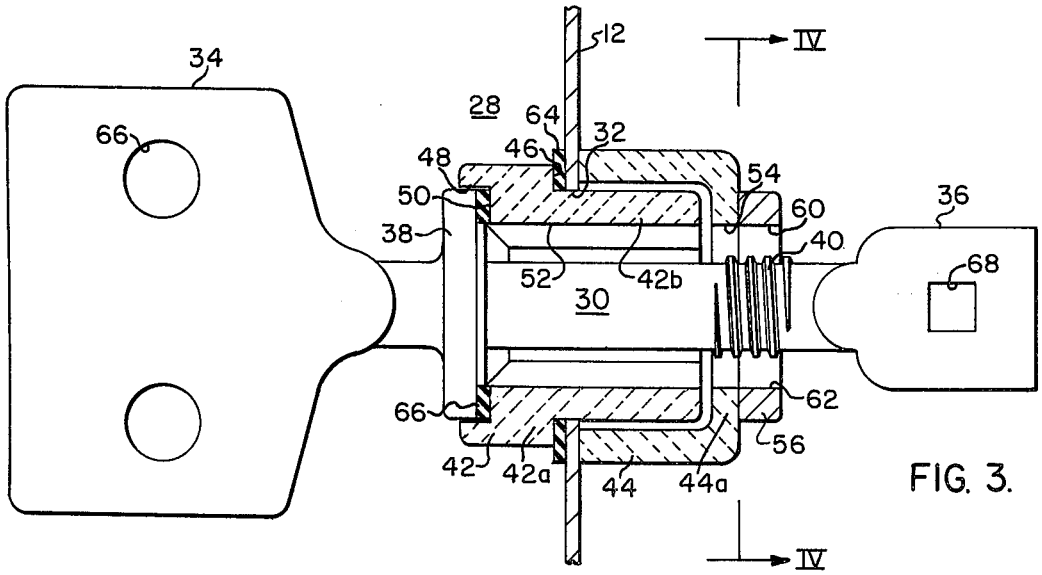
FIG. 3 is a sectional view taken on the line III—III of FIG. 2.
Figure 4:
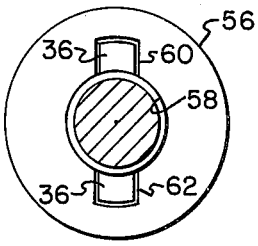
FIG. 4 is a vertical sectional view taken on the line IV—IV of FIG. 3.

In accordance with this invention the connector assembly or bushing 28, which is shown more particularly in FIGS. 2 and 3, comprises a conductor 30 that extends through an aperture 32 in the wall of the casing 12 and comprises an outer flattened terminal portion 34 and an inner flattened terminal portion 36. In addition, the conductor 30 comprises a flange 38 and a threaded segment 40 which are located adjacent the terminal portions 34, 36, respectively. The connector assembly 28 also comprises a pair of tubular insulating members 42, 44 through which the conductor 30 extends. The insulating members 42, 44 are preferably cylindrical and retain the conductor 30 in central alignment with respect to the aperture 32 of the casing 12. More particularly, the insulating member 42 is open ended and comprises an annular external shoulder or surface 46 and an annular notch 48 which provides an outturned annular surface 50. Thus, the insulating member 42 comprises a thickened portion 42a externally of the casing 12 and a portion 42b of smaller wall thickness extending from the shoulder 46 and through the aperture 32 to the right end of the member as shown in FIG. 2. The notch 48 extends outwardly from a bore 52 of the member 42 and it is disposed in the enlarged portion thereof.

The insulating member 44 has a diameter greater than that of the portion 42b and preferably includes an inturned flange or collar 44a forming an aperture 54 having a diameter substantially equal to that of the bore 52. Both the bore 52 and the aperture 54 are sufficiently large to enable the passing of the largest lateral dimension of the terminal portion 36.

The connector assembly 28 also includes clamping means for holding the assembly in place as shown in FIG. 3. The clamping means includes the flange 38, the threaded segment 40, and a tightening nut 56. The nut 56 comprises aperture means including a threaded aperture 58 and a pair of slots 60 and 62 which extend substantially diametrically from opposite sides of the threaded aperture. The slots 60 and 62 have dimensions slightly greater than those of the terminal portion 36 and thereby enable the nut 56 to be passed over the terminal portion during assembly.

In operation, the assembly of the conductor 30 and the insulating member 42 extend through the aperture 32 with the shoulder 46 holding a seal or gasket 64 in place against the external side of the casing 12. The insulating member 44 is disposed against the interior side of the casing 12 and the connector assembly 28 is retained in place with the flange 38 seated in the notch 48 where it retains a gasket 66 against the surface 50 when the nut 56 is tightened on the threaded portion 40.

The terminal portions 34, 36, being planar or flat surfaces, are provided with apertures 66, 68, whereby conductors, such as the conductors 26, are attached in good electrical contact by such means as bolts (not shown). Thus, the enlarged surfaces are sufficient to maintain adequate electrical contact without the usual deformation of the aluminum member due to cold flow.

Accordingly, the electrical bushing of this invention provides a conductor for use with a distribution transformer which is provided with flattened or planar surfaces at opposite ends to enable continuous electrical contact at both ends of the conductor and without the necessity of providing costly or complicated fastening means.

What is claimed is:

1. An electrical bushing suitable for extending through an aperture in a housing wall, the bushing comprising a pair of tubular insulating members having oppositely disposed facing surfaces adapted to engage opposite sides of a housing wall, a conductor extending through the members and having first and second longitudinally extending planar terminal surfaces, means on the conductor for clamping the insulating members in place against said opposite sides and comprising an integral flange having surface means on the conductor near the first planar terminal surface, the means also comprising a threaded segment on the conductor near the second planar terminal surface, the means also comprising a nut engaging the threaded segment, the surface means adapted to abut a first transverse surface on one of said members, the nut abutting a second transverse surface on the other of said members for holding the pair of tubular insulating members in place on a housing wall, the first and second planar terminal surfaces having transverse dimensions greater than the diameter of the threaded segment, the second planar terminal surface being insertable through the tubular insulating members, the nut comprising aperture means including a threaded portion and a slot portion extending outwardly from said threaded portion, and the second planar terminal surface being passable through the aperture means.

2. The electrical bushing of claim 1 in which said conductor is aluminum.

3. The electrical bushing of claim 1 in which one tubular insulating member comprises a portion telescoped within the other tubular insulating member.

* * * * *